US008232742B2

(12) United States Patent
Briggs

(10) Patent No.: US 8,232,742 B2
(45) Date of Patent: Jul. 31, 2012

(54) METHOD, APPARATUS AND COMPUTER-READABLE MEDIA FOR CONTROLLING LIGHTING DEVICES

(75) Inventor: Gerald Edward Briggs, Ottawa, CA (US)

(73) Assignee: Arkalumen Inc., Ottawa (CA)

( * ) Notice: Subject to any disclaimer, the term of this patent is extended or adjusted under 35 U.S.C. 154(b) by 325 days.

(21) Appl. No.: 12/624,414

(22) Filed: Nov. 24, 2009

(65) Prior Publication Data

US 2010/0127632 A1 May 27, 2010

Related U.S. Application Data

(60) Provisional application No. 61/118,457, filed on Nov. 27, 2008.

(51) Int. Cl.
*H05B 37/02* (2006.01)

(52) U.S. Cl. ..... 315/307; 315/250; 315/312

(58) Field of Classification Search ..... 315/247, 315/250, 291, 307, 308, 312, 360
See application file for complete search history.

(56) References Cited

U.S. PATENT DOCUMENTS

| | | | | |
|---|---|---|---|---|
| 6,150,774 | A * | 11/2000 | Mueller et al. | 315/291 |
| 6,198,230 | B1 | 3/2001 | Leeb et al. | |
| 6,400,482 | B1 | 6/2002 | Lupton et al. | |
| 6,426,599 | B1 | 7/2002 | Leeb | |
| 6,504,633 | B1 | 1/2003 | Hovorka et al. | |
| 6,548,967 | B1 | 4/2003 | Dowling et al. | |
| 6,596,977 | B2 | 7/2003 | Muthu et al. | |
| 6,621,235 | B2 | 9/2003 | Chang | |
| 6,794,831 | B2 | 9/2004 | Leeb et al. | |
| 6,954,591 | B2 | 10/2005 | Lupton et al. | |
| 7,016,115 | B1 | 3/2006 | Leeb et al. | |
| 7,321,203 | B2 | 1/2008 | Marosek | |
| 7,486,032 | B2 | 2/2009 | Lee | |
| 7,498,754 | B2 | 3/2009 | Masood | |
| 2005/0269580 | A1 | 12/2005 | D'Angelo | |
| 2006/0049782 | A1 * | 3/2006 | Vornsand et al. | 315/312 |
| 2006/0239689 | A1 | 10/2006 | Ashdown | |
| 2007/0159421 | A1 | 7/2007 | Peker et al. | |
| 2007/0195552 | A1 | 8/2007 | Park | |
| 2008/0079705 | A1 | 4/2008 | Yang et al. | |
| 2008/0138085 | A1 | 6/2008 | Lin et al. | |
| 2008/0180040 | A1 * | 7/2008 | Prendergast et al. | 315/297 |
| 2008/0191642 | A1 | 8/2008 | Slot et al. | |
| 2008/0252664 | A1 | 10/2008 | Huang et al. | |
| 2009/0096392 | A1 | 4/2009 | Chandran et al. | |
| 2009/0251071 | A1 * | 10/2009 | Gater et al. | 315/297 |
| 2011/0115394 | A1 * | 5/2011 | Shteynberg et al. | 315/250 |

* cited by examiner

*Primary Examiner* — Tung X Le
(74) *Attorney, Agent, or Firm* — Murphy IP Consulting Inc.; Sean Murray

(57) ABSTRACT

The present invention is directed to method, system and computer-readable media for controlling lighting devices. In some embodiments, a method for controlling pulse width modulated lighting devices within a lighting apparatus comprising a plurality of sets of lighting devices is disclosed. The method includes setting a counter for a first set of the plurality of sets of lighting devices using a master counter and an activation duration for one or more other sets of the plurality of sets of lighting devices. The method further includes determining an activation time period within a duty cycle for the first set of lighting devices using the counter for the first set of lighting devices and an activation duration for the first set of lighting devices. In some embodiments of the present invention, the lighting devices are light emitting diodes grouped into sets (or banks) and controlled to limit the magnitude and/or quantity of instantaneous current fluctuations in a power supply within the lighting apparatus.

20 Claims, 6 Drawing Sheets

METHOD, APPARATUS AND COMPUTER-READABLE MEDIA FOR CONTROLLING LIGHTING DEVICES

CROSS-REFERENCE TO RELATED APPLICATION

The present application claims the benefit under 35 USC 120 of U.S. Provisional Patent Application 61/118,457, filed on Nov. 27, 2008 and hereby incorporated by reference herein.

FIELD OF THE INVENTION

The invention relates generally to lighting devices and, more particularly, to method, apparatus and computer-readable media for controlling lighting devices.

BACKGROUND

The energy efficiency of light emitting diodes has increased dramatically since they were invented in the 1960s. Many experts in the field compare the continuous improvement of light emitting diodes to Gordon Moore's famous law of microprocessors, with light output per device and energy-efficiency doubling approximately every 18 months. Light emitting diodes can now compete with traditional incandescent and compact fluorescent lighting technologies in terms of light output and energy efficiency.

In one light emitting diode lighting architecture, light emitting diodes of various colors are utilized and the colors of the various diodes are mixed to form a particular color. In one case, there could be red, blue and green light emitting diodes which when turned "on" in particular manners could generate a variety of colors including a white light equivalent.

Each of the light emitting diodes within the lighting architecture could be individually controlled to be "on" for a set period of time within a defined duty cycle using a pulse width modulation technique. In this technique, the intensity of each light emitting diode is defined by the on/off ratio of the diode within the duty cycle, the turning on/off of the diode being a sufficiently short time frame so as not to be perceivable to the human eye. For instance, a duty cycle for the lighting architecture could be set as 1 ms, divided into 256 time segments. In this case, to generate a white light equivalent, the lighting architecture could control the red, blue and green light emitting diodes to be "on" for a relatively similar length of time within each duty cycle. For instance, in one example, the red, blue and green light emitting diodes may each be controlled to be "on" for 128 time segments within the duty cycle (or 50% of the duty cycle). In this case, the intensity of the lighting architecture would be 50% of its potential light output that would occur when all light emitting diodes were "on" 100% of the time.

Light emitting diodes use DC power to generate their light output and therefore lighting architectures employing light emitting diodes require the use of AC to DC converter power supplies if the lighting apparatus is to utilize an AC power source from the public power grid (vs. DC battery power). The cost, lifespan and quality of these power supplies are significant limitations on light emitting diode lighting architectures.

In the sample lighting architecture described above, the power supply will have significantly different current draws when the red, blue and green light emitting diodes are "on" compared to when they are "off". Significant instantaneous fluctuations in current requirements being placed on the power supply can have a number of negative impacts on the power supply and quality of the light output from the light emitting diodes. For instance, the instantaneous fluctuations in current requirements can result in deteriorating performance of the power supply as significant changes in instantaneous power loads occurring continuously strain the power supply components, such as the voltage stabilizing capacitors. Further, the fluctuations in current requirements can potentially cause the power supply to temporarily not be able to handle a specific current change, and hence potentially cause an undesirable turning "off" of one or more of the light emitting diodes. This may result in a perceivable flicker in the light output or a change in the color of the overall light projected from the lighting architecture. Additionally, when a periodic instantaneous current fluctuation at audio frequencies occurs, an audible ringing or hum may be produced.

Against this background, there is a need for solutions that will better control the light emitting diodes within a lighting apparatus in order to reduce instantaneous current fluctuations within the power supply.

SUMMARY OF THE INVENTION

According to a first broad aspect, the invention seeks to provide a method for controlling pulse width modulated lighting devices within a lighting apparatus, the lighting apparatus comprising a plurality of sets of lighting devices. The method comprises setting a counter for a first set of the plurality of sets of lighting devices using a master counter and an activation duration for one or more other sets of the plurality of sets of lighting devices. Further, the method comprises determining an activation time period within a duty cycle for the first set of lighting devices using the counter for the first set of lighting devices and an activation duration for the first set of lighting devices.

According to a second broad aspect, the invention seeks to provide a control apparatus comprising a plurality of interfaces, each coupled to a respective one of a plurality of sets of pulse width modulated lighting devices, and a processing entity, coupled to the plurality of interfaces. The processing entity is configured to set a counter for a first set of the plurality of sets of lighting devices using a master counter and an activation duration for one or more other sets of the plurality of sets of lighting devices. The processing entity is further configured to determine an activation time period within a duty cycle for the first set of lighting devices using the counter for the first set of lighting devices and an activation duration for the first set of lighting devices.

According to a third broad aspect, the invention seeks to provide a computer-readable media containing a program element executable by a computing system to perform a method for controlling pulse width modulated lighting devices within a lighting apparatus, the lighting apparatus comprising a plurality of sets of lighting devices. The program element comprises program code for setting a counter for a first set of the plurality of sets of lighting devices using a master counter and an activation duration for one or more other sets of the plurality of sets of lighting devices; and program code for determining an activation time period within a duty cycle for the first set of lighting devices using the counter for the first set of lighting devices and an activation duration for the first set of lighting devices.

According to a fourth broad aspect, the invention seeks to provide a method for controlling a plurality of sets of lighting devices, each of the sets of lighting devices having an activation duration within a duty cycle. The method comprises setting start and end times for activation of each of the plurality of sets of lighting devices within the duty cycle to activate the set of lighting devices for its corresponding activation duration. The plurality of sets of lighting devices are powered by a single power supply and the start and end times for activation of each of the plurality of sets of lighting devices are set to mitigate instantaneous fluctuations in current within the power supply.

In some embodiments, the plurality of sets of lighting devices comprises sets of lighting devices of different colors. In this case, the activation durations within the duty cycle corresponding to the plurality of sets of lighting devices are set to generate a particular light spectrum output. In other embodiments, the plurality of sets of lighting devices comprises sets of lighting devices of a single color. In this case, a sum of the activation durations within the duty cycle corresponding to the plurality of sets of lighting devices comprises an overall activation duration for the single color, the overall activation duration being set to generate a particular light intensity for the single color. In some embodiments, the plurality of sets of lighting devices comprises a plurality of sets of white lighting devices.

According to a fifth broad aspect, the invention seeks to provide a method for controlling a plurality of sets of lighting devices, each of the sets of lighting devices having an activation duration within a duty cycle. The method comprises setting start and end times for activation of each of the plurality of sets of lighting devices within the duty cycle to activate the set of lighting devices for its corresponding activation duration. The start time of at least a first one of the plurality of sets of lighting devices is synchronized with the end time of at least a second one of the plurality of sets of lighting devices.

According to a sixth broad aspect, the invention seeks to provide a method for controlling a plurality of sets of lighting devices, each of the sets of lighting devices having an activation duration within a duty cycle. The method comprises setting start and end times for activation of a first one of the sets of lighting devices within the duty cycle to activate the first set of lighting devices for its corresponding activation duration. The method further comprises setting start and end times for activation of a second one of the sets of lighting devices within the duty cycle to activate the second set of lighting devices for its corresponding activation duration, the start time of the second set of lighting devices being synchronized with the end time of the first set of lighting devices.

According to a seventh broad aspect, the invention seeks to provide a method for controlling a plurality of lighting devices within a duty cycle. The method comprises activating a first set of one or more lighting devices at a first time within the duty cycle; and deactivating the first set of one or more lighting devices and activating a second set of one or more lighting devices at a second time within the duty cycle.

According to an eighth broad aspect, the invention seeks to provide a method for controlling a plurality of sets of lighting devices, each of the sets of lighting devices having an activation duration within a duty cycle. The method comprises setting start and end times for activation of each of the plurality of sets of lighting devices within the duty cycle to activate the set of lighting devices for its corresponding activation duration and to limit instantaneous fluctuations in current requirements for the plurality of sets of lighting devices across the duty cycle.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to a method, system and computer-readable media for controlling lighting devices. Within embodiments described below, a lighting apparatus according to the present invention controls a plurality of lighting devices in order to mitigate the magnitude and/or quantity of current fluctuations within the power supply.

Figure 1:
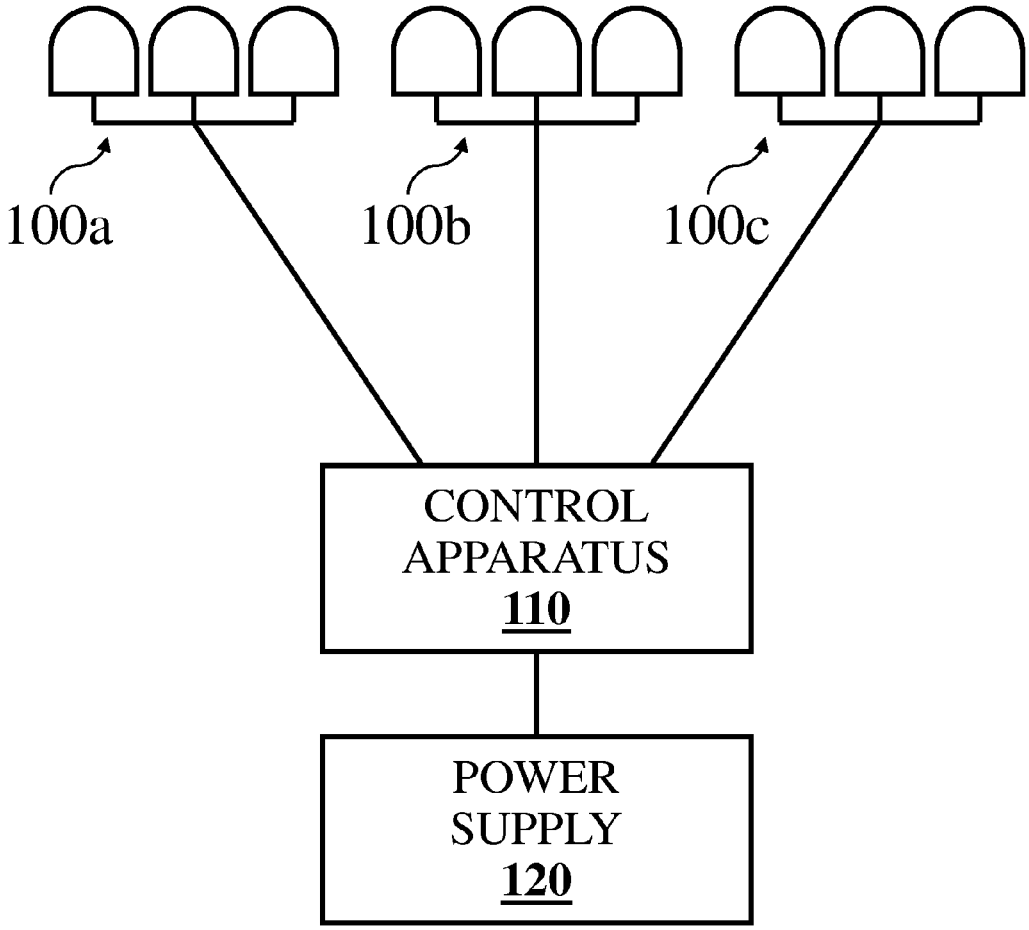
FIG. 1 is a block diagram of a lighting apparatus including a plurality of banks of light emitting diodes.

FIG. 1 illustrates a block diagram of a lighting apparatus that could be utilized to implement the present invention. The lighting apparatus of FIG. 1 comprises a plurality of banks (or sets) of light emitting diodes 100*a*,100*b*,100*c* individually coupled to a control apparatus 110. The control apparatus 110 is coupled to a power supply 120, which provides the control apparatus 110 with a supply of DC power. The power supply 120 may be coupled to an AC power source and hence perform an AC to DC conversion operation. Alternatively, the power supply 120 could be an independent DC power source, for example, one or more batteries, generators and/or alternative energy sources such as solar panels.

In the embodiment of FIG. 1, the control apparatus 110 independently controls the supply of power to the banks of light emitting diodes 100*a*,100*b*,100*c* using three pulse width modulated signals. In this manner, the control apparatus 110 can turn each of the banks of light emitting diodes 100*a*,100*b*, 100*c* "on" for a set time period (or number of discrete time segments) within a predefined duty cycle.

In one example embodiment, the banks of light emitting diodes comprises a bank of red light emitting diodes 100*a*, a bank of blue light emitting diodes 100*b* and a bank of green light emitting diodes 100*c*. In this case, the number of time segments within the duty cycle that each of the banks of light emitting diodes 100*a*,100*b*,100*c* is "on" will dictate the intensity of the light projected from the light emitting diodes and the perceived color of that light. For instance, if all three banks of light emitting diodes 100*a*, 100*b*, 100*c* were "on" for 75% of the duty cycle, the resulting light output may be perceived as relatively equivalent to white light (if the colors are mixed appropriately) and the intensity of that white light would be 75% of the potential light output for the lighting apparatus. In another instance, if the banks of red and blue light emitting diodes 100*a*, 100*b* were "on" for 50% of the duty cycle and the bank of green light emitting diodes 100*c* were not turned "on" at all by the control apparatus 110, the resulting light output may be perceived as a color of purple with an intensity of 50% of the potential purple color or an intensity of approximately 33% of the overall lighting apparatus potential light output (assuming that the light output in lumens of each bank of light emitting diodes is relatively proportional). It should be understood, there are a tremendous number of various combinations for controlling the banks of light emitting diodes 100*a*,100*b*,100*c* that would result in different colors and/or intensities of light output for the lighting apparatus. In fact, in an example embodiment, in which there are 256 time segments within a duty cycle and three banks of different colored light emitting diodes, a total of more than 16 million combinations of color and/or intensity are possible.

Although depicted as a single apparatus in FIG. 1, it should be understood that the control apparatus 110 may comprise a plurality of apparatus working in tandem to control the plurality of banks of light emitting diodes 100*a*,100*b*,100*c*. Further, although depicted as three banks of light emitting diodes, each bank comprising three light emitting diodes, the number of banks of light emitting diodes and the number of light emitting diodes per bank are not meant to limit the scope of the present invention. Specifically, lighting apparatus with as few as two banks of light emitting diodes could benefit from the implementation of the present invention. Further, the present invention could be utilized with lighting apparatus with many more than three banks of light emitting diodes. Each bank of light emitting diodes could comprise as few as one light emitting diode and as many light emitting diodes as the power supply and heat management of the lighting apparatus can handle. Further, it should be understood the colors of the light emitting diodes should not be limiting. Each of the banks of light emitting diodes could comprise the same color (ex. red, blue, green, amber, white etc.) or some combination of banks of light emitting diodes could comprise light emitting diodes of different colors.

Figure 2:
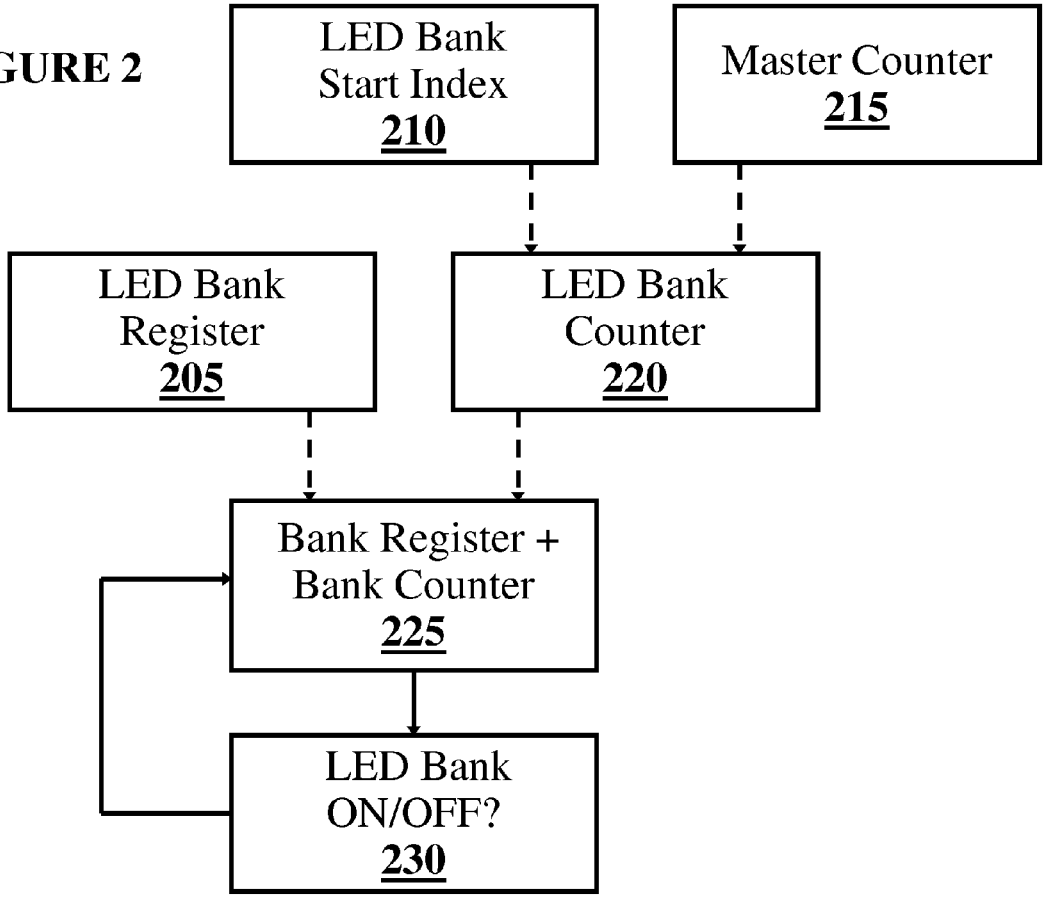
FIG. 2 is a flow diagram according to an embodiment of the present invention illustrating steps of a control algorithm for a particular one of the banks of light emitting diodes of FIG. 1 and the inputs to that control algorithm.

FIG. 2 depicts a flow diagram according to an embodiment of the present invention illustrating steps of a control algorithm for a particular one of the banks of light emitting diodes of FIG. 1 and the inputs to that control algorithm. The control algorithm is utilized to determine when to turn the particular bank of light emitting diodes "on" or "off". Each of the banks of light emitting diodes 100*a*,100*b*,100*c* of FIG. 1 have a similar control algorithm operating to determine the on/off decision.

One input to the control algorithm of FIG. 2 is an LED bank register 205, which may comprise a byte of data. The LED bank register 205 is an indication of the amount of time within a duty cycle that the particular bank of light emitting diodes are to be turned "on". The LED bank register 205 could also be considered an activation duration for the particular bank of light emitting diodes. In the above example in which a duty cycle is divided into 256 segments, the LED bank register 205 can be a value between 0 and 255. It should be understood that the LED bank register 205 could be within a different range if the duty cycle is divided up differently and comprise less than or greater than a byte of data. Further, in some embodiments, the LED bank register could comprise non-whole numbers.

Each bank of light emitting diodes within a lighting apparatus would have a corresponding LED bank register 205. The various LED bank registers could be of different values across the plurality of banks of light emitting diodes or be the same. In some embodiments, the LED bank register 205 could be common between two or more of the banks of light emitting diodes. A common LED bank register 205 between banks of light emitting diodes is particularly relevant if the banks comprise light emitting diodes of the same or similar colors. It should be understood that common LED bank registers 205 could also apply across banks of light emitting diodes of different colors, though this constraint would limit the flexibility of color changes within the lighting apparatus.

A second input to the control algorithm of FIG. 2 is an LED bank start index 210. The LED bank start index 210 is a value that dictates the time in which the particular bank of light emitting diodes will be triggered to turn "on". The index 210 is calculated based on an order of the banks of light emitting diodes and the LED bank registers 205 of the banks of light emitting that are ordered ahead of the particular bank of light emitting diodes. The order of the plurality of banks of light emitting diodes can be predefined or dynamically generated upon a trigger. The LED bank start index 210 is calculated by adding together the LED bank registers 205 for the banks of light emitting diodes that are ordered ahead of the particular bank of light emitting diodes. For instance, if the bank of light emitting diodes is set as the first bank, then the LED bank start index 210 for that particular bank could be set as zero. If the bank of light emitting diodes is set as the second bank, then the LED bank start index 210 for that particular bank could be set as the LED bank register corresponding to the bank of light emitting diodes set as the first bank. If the bank of light emitting diodes is set as the third bank, then the LED bank start index 210 for that particular bank could be set as the sum of the LED bank registers corresponding to the banks of light emitting diodes set as the first and second banks. Further banks of light emitting diodes could have their LED bank start index 210 set in a similar manner, being the summation of all previous LED bank registers.

It should be noted that although the bank of light emitting diodes set as the first bank may have its LED bank start index 210 set to zero, other values could be used. If a different value is used than zero, the LED bank start indices 210 of the other banks of light emitting diodes should be shifted by that value.

A third input to the control algorithm of FIG. 2 is a master counter 215. The master counter 215 is a clock input that cyclically counts through the time segments of the duty cycle. In the example embodiment in which the duty cycle comprises 256 segments, the master counter 215 counts between 0 and 255, the time between segments being equal to the duty cycle time divided by the number of segments. For instance, if the duty cycle is set as 1 ms and the duty cycle comprises 256 segments, each segment would comprise ~3.9 μs. In other embodiments, the duty cycle may be set as a different length of time and the number of segments per duty cycle may be larger or smaller than 256. Further, although the master counter 215 as described herein counts incrementally up in number, the master counter 215 could count down. For instance, if the duty cycle comprises 256 segments, the master counter 215 could cyclically count from 255 to 0. In another embodiment, the master counter may also not be and actual byte register but rather an abstract of a counter embedded in sequential program code of the control algorithm.

Utilizing the LED bank start index 210 for a particular bank of light emitting diodes and the master counter 215, an LED bank counter 220 can be calculated for that particular bank of light emitting diodes. In one embodiment, the LED bank counter 220 is calculated by adding the LED bank start index 210 for the particular bank of light emitting diodes and the master counter 215, the number of segments of the duty cycle being a cap that causes a carry bit in the addition. For instance, if the duty cycle comprises 256 segments (0 to 255), the LED bank start index 210 is at a value of 200 and the master counter 215 at that moment is at a value of 100, the addition would result in a value of 45 with one carry bit. To generate the LED bank counter 220, the addition is used while ignoring any carry bits that are generated. Therefore, the LED bank counter 220 is always within the range of the number of segments in the duty cycle and increases as the master counter 215 increases. The LED bank counter 220 reverts to a value of zero when the LED bank start index 210 of the particular bank of light emitting diodes combined with the master counter 215 first generates a carry bit as the master counter progresses over time. The LED bank counter 220 then continues to increase from zero as the master counter 215 continues to increase. Effectively, the LED bank counter 220 is synchronized with the master counter 215 but shifted by the value of the LED bank start index 210 for that particular bank of light emitting diodes.

The control algorithm of FIG. 2 for a particular bank of light emitting diodes utilizes the LED bank register 205 and the LED bank counter 220 of that particular bank of light emitting diodes to make decisions on whether to turn "on" or "off" the particular bank of light emitting diodes. As depicted in FIG. 2 at step 225, the LED bank register 205 and the LED bank counter 220 are summed together to generate a value. The value is capped at the number of time segments of the duty cycle such that a carry bit is generated if the value is greater than the number of segments of the duty cycle. For instance, if the duty cycle comprises 256 time segments, the LED bank register 205 comprises a value of 150 and the LED bank counter 220 is at that moment at a value of 50, the summation would result in a value of 200. Once the LED bank counter 220 increases to a value of 156, the summation would result in a value of 0 with one carry bit. When the LED bank counter 220 increases to a value of 255, the summation would result in a value of 149 with one carry bit. When the LED bank counter 220 then reverts back to a value of 0, the summation would become 150 with no carry bit.

At step 230, the control algorithm of FIG. 2 subsequently makes a decision whether to turn "on" or "off" the particular bank of light emitting diodes based on examining the results of the summation of step 225. If the summation of step 225 results in a carry bit, the control algorithm triggers the particular bank of light emitting diodes to be "on". If the summation of step 225 does not result in a carry bit, the control algorithm triggers the particular bank of light emitting diodes to be "off". In other words, if the summation of the particular LED bank register 205 and LED bank counter 220 at a particular moment in time is greater than the number of time segments in the duty cycle, the control algorithm triggers the bank of light emitting diodes to be "on". Otherwise, the particular bank of light emitting diodes will be triggered to be "off".

In one embodiment, if the particular bank of light emitting diodes is to be triggered "on", the control apparatus 110 provides a high voltage to the particular bank of light emitting diodes. If the particular bank of light emitting diodes is to be triggered "off", the control apparatus 110 provides a low voltage to the particular bank of light emitting diodes. In other embodiments, other means of triggering on/off could be performed by the control apparatus 110. For instance, the control apparatus could selectively couple the particular bank of light emitting diodes to the power supply 120 when triggering the bank to be "on" and selectively decouple the particular bank of light emitting diodes from the power supply 120 when triggering the bank to be "off".

The control algorithm of FIG. 2 is processed simultaneously for each of the banks of light emitting diodes within the lighting apparatus. In this manner, on/off decisions for all of the banks of light emitting diodes are being completed for each time segment within the plurality of time segments of a duty cycle. As will be shown by example with reference to FIGS. 3A-3D below, the control algorithm of FIG. 2, when applied to all of the banks of light emitting diodes in the lighting apparatus, coordinate the on/off decisions for the banks of light emitting diodes in order to minimize the quantity and/or magnitude of current fluctuations on the power supply 120. It will be illustrated by example that the control algorithm of FIG. 2 when completed for each of the banks of light emitting diodes within a lighting apparatus results in the turning "on" of a first bank of light emitting diodes to be synchronized with the turning "off" of a second bank of light emitting diodes.

With this synchronization, the current draw can be kept relatively even/smooth if the first and second banks of light emitting diodes draw relatively equal levels of current. Even if the first and second banks of light emitting diodes do not draw equal levels of current, the synchronization mitigates the magnitude change in the current draw from the power supply 120. In one embodiment, if there are a large number of light emitting diodes of a single type within a lighting apparatus, those light emitting diodes may be divided into two or more banks of light emitting diodes. In some cases, this could make the current draw from these banks of light emitting diodes be more proportional to other banks of light emitting diodes within the lighting apparatus and, therefore, better even/smooth the magnitude changes in current draws in the control algorithm of the present invention.

It should be understood that the control algorithm of FIG. 2 is only one embodiment to achieve the desired reduction in magnitude and/or quantity of current fluctuations. One skilled in the art could modify the specific control algorithm of FIG. 2 and, in particular, the various inputs of the control algorithm could be modified as described above and/or the two steps 225,230 could be expanded on or simplified while still enabling synchronization of the turning on/off of the banks of light emitting diodes.

FIGS. 3A, 3B, 3C and 3D are signal flow and current level diagrams for various sample duty cycles for red, blue and green light emitting diode banks according to an embodiment of the present invention. In each of the diagrams, two duty cycles of time are illustrated, each duty cycle being broken down into eight time segments. In this case, the master counter 215 cyclically counts from 0 to 7.

In the examples of FIGS. 3A-3D, the current requirements for each bank of light emitting diodes is set as equal for simplicity. It should be understood that the current requirements for the banks of light emitting diodes can be different and, in fact, are likely to be different due to different specifications of light emitting diodes and the potential that each of the banks of light emitting diodes may have a different number of light emitting diodes.

Figure 3A:
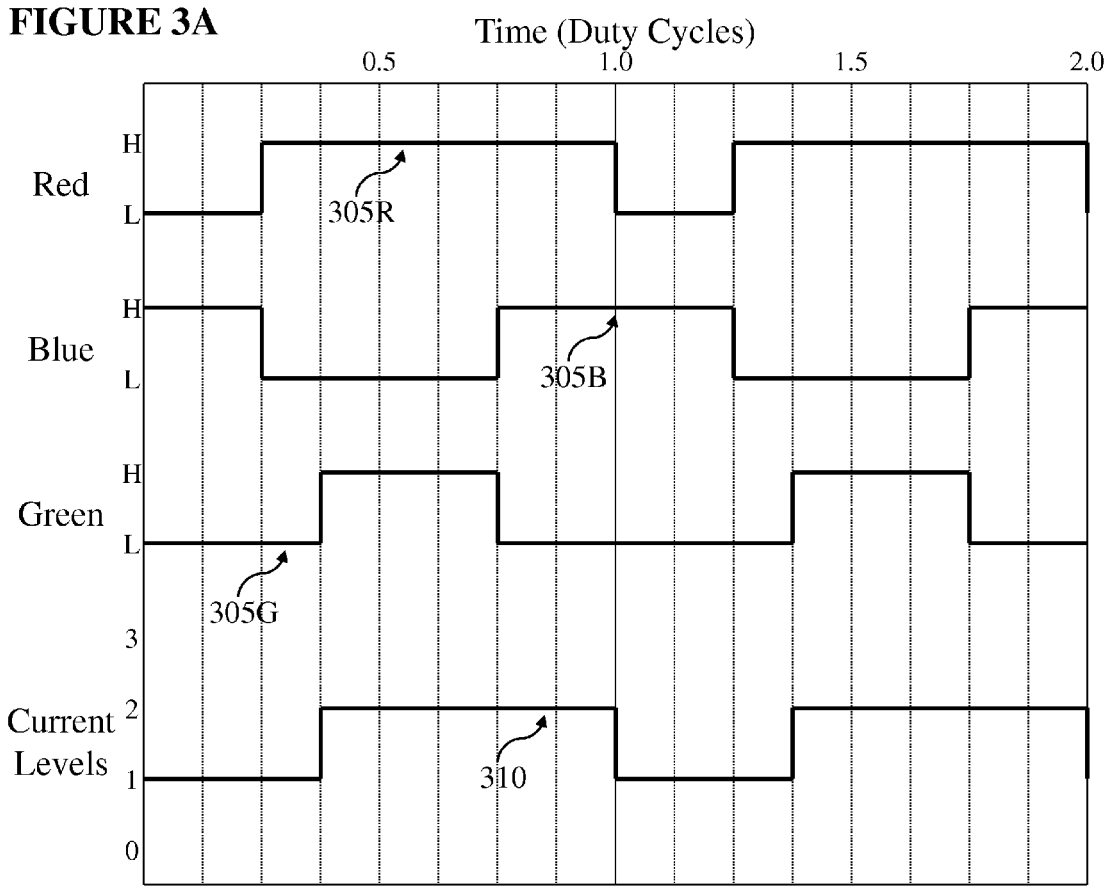
FIGS. 3A, 3B, 3C and 3D are signal flow and current level diagrams for various sample duty cycles for red, blue and green light emitting diode banks according to an embodiment of the present invention.

In the example of FIG. 3A, the banks of red, blue and green light emitting diodes have 75%, 50% and 37.5% duty cycles respectively. This coincides with LED bank registers 205 of 6, 4 and 3 respectively in this case where there are a total of 8 time segments, numbered respectively 0 through 7. Setting the order of the banks of light emitting diodes as red, blue, green results in LED bank start indices 210 for the banks of red, blue and green light emitting diodes as 0, 6 (red LED bank register) and 10 (red LED bank register+blue LED bank register) respectively. In modulo 8 math, 10 is the equivalent of 2. Therefore, the LED bank counter 220 for the bank of red light emitting diodes would be identical to the master counter 215 and operate cyclically as 0,1,2,3,4,5,6,7. The LED bank counter 220 for the bank of blue light emitting diodes would be shifted by 6 time segments or effectively operate as 6,7,0, 1,2,3,4,5. The LED bank counter 220 for the bank of green light emitting diodes would be shifted by 2 time segments (since the carry bit when the summation is 8 or greater would be ignored) or effectively operate as 2,3,4,5,6,7,0,1.

Signal flow diagram 305R depicts the time segments in which the bank of red light emitting diodes is "on" (indicated with a H for high voltage) or "off" (indicated with an L for low voltage). In this case, the sum of the red LED bank register (6) and the red LED bank counter results in a carry bit (i.e. is equal to or greater than the number of time segments in the duty cycle) during time segments 2 through 7 of each duty cycle. As per the above described control algorithm of FIG. 2, the bank of red light emitting diodes would be turned "on" when the summation results in a carry bit. Signal flow diagram 305B depicts the time segments in which the bank of blue light emitting diodes is "on" or "off". In this case, the sum of the blue LED bank register (4) and the blue LED bank counter results in a carry bit (i.e. is equal to or greater than the number of time segments in the duty cycle) during time segments 0, 1, 6 and 7 of each duty cycle, hence being "on" during those time segments. Signal flow diagram 305G depicts the time segments in which the bank of green light emitting diodes is "on" or "off". In this case, the sum of the green LED bank register (3) and the green LED bank counter results in a carry bit (i.e. is equal to or greater than the number of time segments in the duty cycle) during time segments 4 through 6 of each duty cycle, hence being "on" during those time segments.

As illustrated in current level diagram 310, the power supply 120 would supply a single bank of light emitting diodes with power during time segments 0 through 2 of each duty cycle and supply two banks of light emitting diodes with power during time segments 3 through 7. As shown, there is no transitions in current requirements greater than the current requirements of a single bank of light emitting diodes. In this particular example, only two current fluctuations occur, each current fluctuation being equal to the current demands of a single bank of light emitting diodes.

Figure 3B:
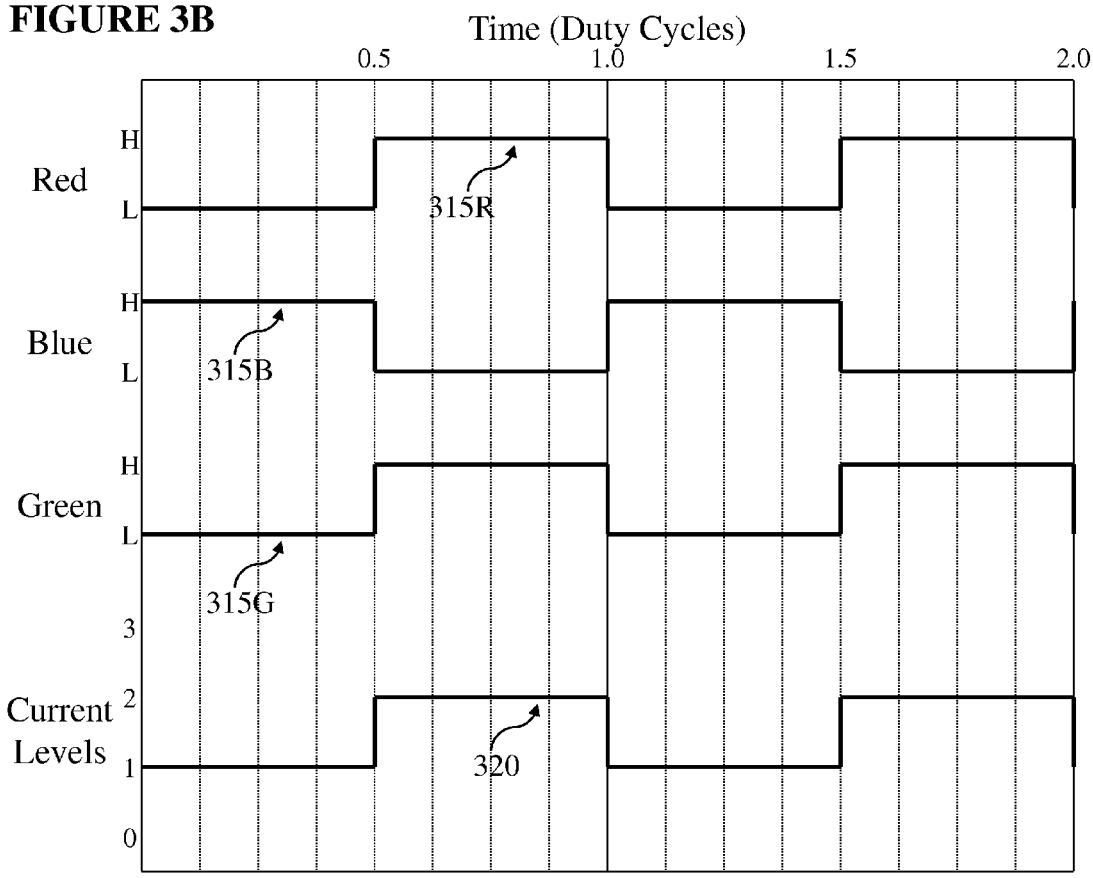

In the example of FIG. 3B, the banks of red, blue and green light emitting diodes each have a 50% duty cycle. This coincides with each having LED bank registers 205 of 4 in this case where there are a total of 8 time segments, numbered respectively 0 through 7. Setting the order of the banks of light emitting diodes as red, blue, green results in LED bank start indices 210 for the banks of red, blue and green light emitting diodes as 0, 4 (red LED bank register) and 8 (red LED bank register+blue LED bank register) respectively. In modulo 8 math, 8 is the equivalent of 0. Therefore, the LED bank counter 220 for the bank of red light emitting diodes would be identical to the master counter 215 and operate cyclically as 0,1,2,3,4,5,6,7. The LED bank counter 220 for the bank of blue light emitting diodes would be shifted by 4 time segments or effectively operate cyclically as 4,5,6,7,0,1,2,3. The LED bank counter 220 for the bank of green light emitting diodes would be identical to the master counter 215 (since the carry bit when the summation is 8 or greater would be ignored) or effectively operate cyclically as 0,1,2,3,4,5,6,7.

Signal flow diagram 315R depicts the time segments in which the bank of red light emitting diodes is "on" (indicated with a H for high voltage) or "off" (indicated with an L for low voltage). In this case, the sum of the red LED bank register (4) and the red LED bank counter results in a carry bit (i.e. is equal to or greater than the number of time segments in the duty cycle) during time segments 4 through 7 of each duty cycle. As per the above described control algorithm of FIG. 2, the bank of red light emitting diodes would be turned "on" when the summation results in a carry bit. Signal flow diagram 315B depicts the time segments in which the bank of blue light emitting diodes is "on" or "off". In this case, the sum of the blue LED bank register (4) and the blue LED bank counter results in a carry bit (i.e. is equal to or greater than the number of time segments in the duty cycle) during time segments 0 through 3 of each duty cycle, hence being "on" during those time segments. Signal flow diagram 315G depicts the time segments in which the bank of green light emitting diodes is "on" or "off". In this case, the sum of the green LED bank register (4) and the green LED bank counter results in a carry bit (i.e. is equal to or greater than the number of time segments in the duty cycle) during time segments 4 through 7 of each duty cycle, hence being "on" during those time segments.

As illustrated in current level diagram 320, the power supply 120 would supply a single bank of light emitting diodes with power during time segments 0 through 3 of each duty cycle and supply two banks of light emitting diodes with power during time segments 4 through 7. As shown, there is no transitions in current requirements greater than the current requirements of a single bank of light emitting diodes. In this particular example, only two current fluctuations occur, each current fluctuation being equal to the current demands of a single bank of light emitting diodes.

Figure 3C:
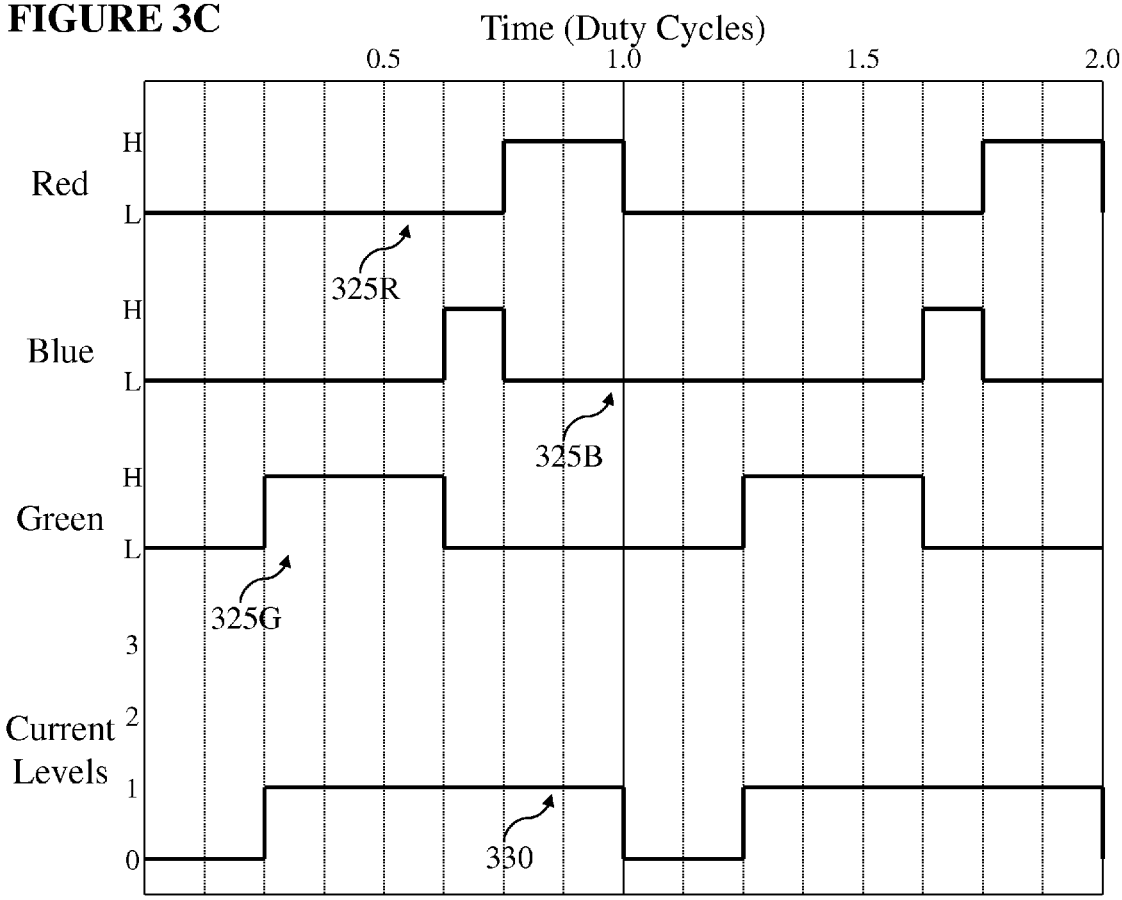

In the example of FIG. 3C, the banks of red, blue and green light emitting diodes have 25%, 12.5% and 37.5% duty cycles respectively. This coincides with LED bank registers 205 of 2, 1 and 3 respectively in this case where there are a total of 8 time segments, numbered respectively 0 through 7. Setting the order of the banks of light emitting diodes as red, blue, green results in LED bank start indices 210 for the banks of red, blue and green light emitting diodes as 0, 2 (red LED bank register) and 3 (red LED bank register+blue LED bank register) respectively. Therefore, the LED bank counter 220 for the bank of red light emitting diodes would be identical to the master counter 215 and operate cyclically as 0,1,2,3,4,5,6,7. The LED bank counter 220 for the bank of blue light emitting diodes would be shifted by 2 time segments or effectively operate cyclically as 2,3,4,5,6,7,0,1. The LED bank counter 220 for the bank of green light emitting diodes would be shifted by 3 time segments or effectively operate cyclically as 3,4,5,6,7,0,1,2.

Signal flow diagram 325R depicts the time segments in which the bank of red light emitting diodes is "on" (indicated with a H for high voltage) or "off" (indicated with an L for low voltage). In this case, the sum of the red LED bank register (2) and the red LED bank counter results in a carry bit (i.e. is equal to or greater than the number of time segments in the duty cycle) during time segments 6 and 7 of each duty cycle. As per the above described control algorithm of FIG. 2, the bank of red light emitting diodes would be turned "on" when the summation results in a carry bit. Signal flow diagram 325B depicts the time segments in which the bank of blue light emitting diodes is "on" or "off". In this case, the sum of the blue LED bank register (1) and the blue LED bank counter results in a carry bit (i.e. is equal to or greater than the number of time segments in the duty cycle) during time segment 5 of each duty cycle, hence being "on" during this time segment. Signal flow diagram 325G depicts the time segments in which the bank of green light emitting diodes is "on" or "off". In this case, the sum of the green LED bank register (3) and the green LED bank counter results in a carry bit (i.e. is equal to or greater than the number of time segments in the duty cycle) during time segments 2 through 4 of each duty cycle, hence being "on" during those time segments.

As illustrated in current level diagram 330, the power supply 120 would supply a single bank of light emitting diodes with power during time segments 2 through 7 of each duty cycle and supply no banks of light emitting diodes with power during time segments 0 and 1. As shown, there is no transitions in current requirements greater than the current requirements of a single bank of light emitting diodes. In this particular example, only two current fluctuations occur, each current fluctuation being equal to the current demands of a single bank of light emitting diodes.

Figure 3D:
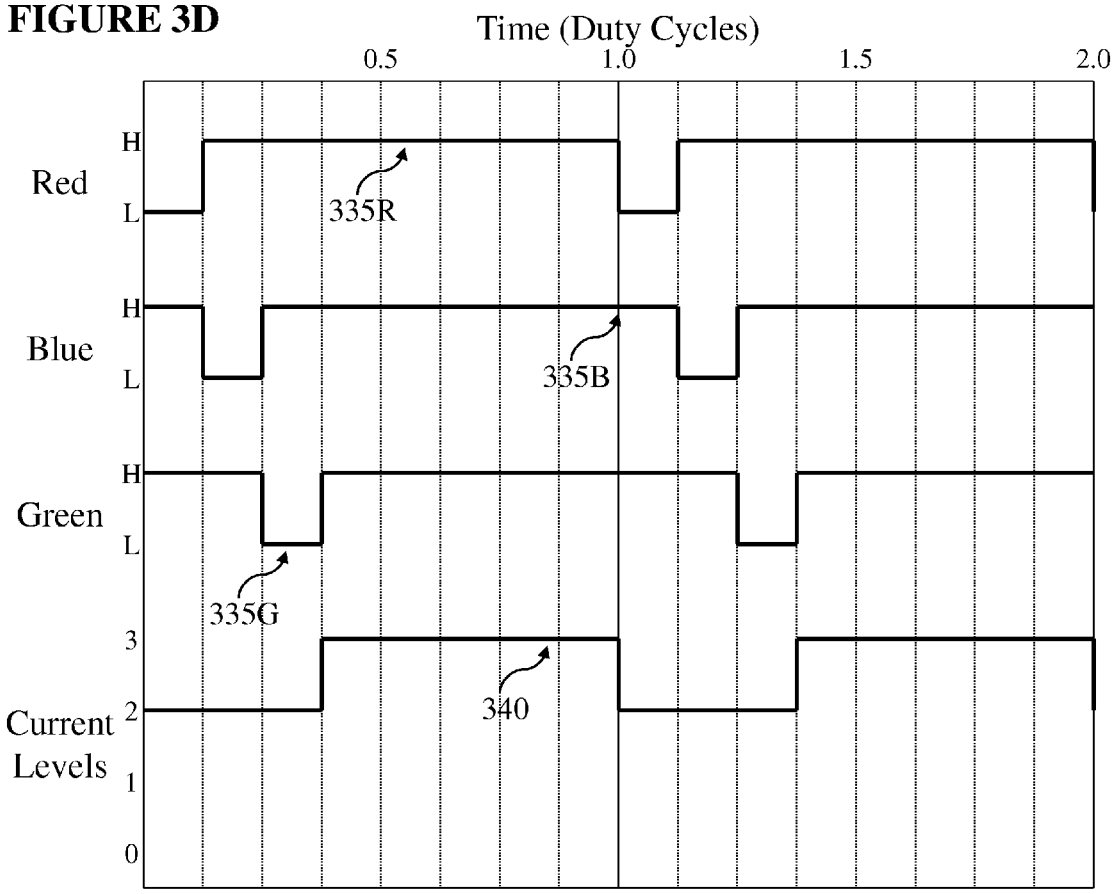

In the example of FIG. 3D, the banks of red, blue and green light emitting diodes each have a 87.5% duty cycle. This coincides with each having LED bank registers 205 of 7 in this case where there are a total of 8 time segments, numbered respectively 0 through 7. Setting the order of the banks of light emitting diodes as red, blue, green results in LED bank start indices 210 for the banks of red, blue and green light emitting diodes as 0, 7 (red LED bank register) and 14 (red LED bank register+blue LED bank register) respectively. In modulo 8 math, 14 is the equivalent of 6. Therefore, the LED bank counter 220 for the bank of red light emitting diodes would be identical to the master counter 215 and operate cyclically as 0,1,2,3,4,5,6,7. The LED bank counter 220 for the bank of blue light emitting diodes would be shifted by 7 time segments or effectively operate cyclically as 7,0,1,2,3, 4,5,6. The LED bank counter 220 for the bank of green light emitting diodes would be shifted by 6 time segments (since the carry bit when the summation is 8 or greater would be ignored) or effectively operate cyclically as 6,7,0,1,2,3,4,5.

Signal flow diagram 335R depicts the time segments in which the bank of red light emitting diodes is "on" (indicated with a H for high voltage) or "off" (indicated with an L for low voltage). In this case, the sum of the red LED bank register (7) and the red LED bank counter results in a carry bit (i.e. is equal to or greater than the number of time segments in the duty cycle) during time segments 1 through 7 of each duty cycle. As per the above described control algorithm of FIG. 2, the bank of red light emitting diodes would be turned "on" when the summation results in a carry bit. Signal flow diagram 335B depicts the time segments in which the bank of blue light emitting diodes is "on" or "off". In this case, the sum of the blue LED bank register (7) and the blue LED bank counter results in a carry bit (i.e. is equal to or greater than the number of time segments in the duty cycle) during time segments 0 and 2 through 7 of each duty cycle, hence being "on" during those time segments. Signal flow diagram 335G depicts the time segments in which the bank of green light emitting diodes is "on" or "off". In this case, the sum of the green LED bank register (7) and the green LED bank counter results in a carry bit (i.e. is equal to or greater than the number of time segments in the duty cycle) during time segments 0, 1 and 3 through 7 of each duty cycle, hence being "on" during those time segments.

As illustrated in current level diagram 340, the power supply 120 would supply two banks of light emitting diodes with power during time segments 0 through 2 of each duty cycle and supply all three banks of light emitting diodes with power during time segments 3 through 7. As shown, there is no transitions in current requirements greater than the current requirements of a single bank of light emitting diodes. In this particular example, only two current fluctuations occur, each current fluctuation being equal to the current demands of a single bank of light emitting diodes.

It should be understood that the example implementations illustrated with FIGS. 3A-3D are not meant to limit the scope of the present invention. In other embodiments, other numbers of banks of light emitting diodes could be utilized. Further, the banks of light emitting diodes could comprise different colors of light emitting diodes. Potentially all banks of light emitting diodes could comprise that same color of light emitting diodes and/or each bank of light emitting diodes could have light emitting diodes of various wavelengths. Also, although the current requirements of each of the banks of light emitting diodes was set as equal in FIGS. 3A-3D, it should be understood that this may not be the case and, in fact, there likely would be some variations in current requirements across the banks of light emitting diodes. If the banks of light emitting diodes do have different current requirements, the quantity of current fluctuations would be increased, though the control algorithm would still keep the magnitude of the current fluctuations limited.

In some embodiments of the present invention, the perceived amplitude of light from a bank of light emitting diodes can be further refined by introducing a secondary parameter that increases by one the number of time segments where the bank of light emitting diodes is "on" for every Nth cycle, where N represents the fractional amplitude increase. Effectively, one or more of the banks of light emitting diodes may have their number of time segments "on" adjusted across a plurality of duty cycles to achieve a more refined desired duty cycle. This is especially relevant if a desired percentage "on" time for the bank of light emitting diodes does not evenly divide by the number of time segments within a duty cycle. In this case, the LED bank register 205 may be adjusted so that it averages the appropriate value over a plurality of duty cycles.

For instance, if the duty cycle was divided into 256 time segments and a duty cycle of 50.195% was desired, neither an LED bank register of 128 (duty cycle=50%) or an LED bank register of 129 (duty cycle=50.391%) would get the desired duty cycle. In this case, the LED bank register 205 of the bank of light emitting diodes could be adjusted across a plurality of duty cycles to average a value of 128.5, which would result in the desired duty cycle. In one case, this could be achieved by utilizing an LED bank register of 128 for the bank in one duty cycle, followed by an LED bank register of 129 in the next duty cycle; adjusting back and forth each duty cycle. Alternatively, the LED bank register could be maintained at 128 for a set number of duty cycles and then changed to 129 for the same number of duty cycles. The control algorithm of FIG. 2 described above would be slightly adjusted with each change in LED bank register 205, thus maintaining the benefits of the present invention.

It should be recognized that although described for setting an average LED bank register to 128.5 in a duty cycle with 256 time segments, it should be understand the algorithm of slightly adjusting LED bank registers across a plurality of duty cycles enables the setting of a large number of very precise desired LED bank registers. Hence, LED bank registers 205 do not need to be divisible by the number of time segments but can be calculated by multiplying a desired duty cycle with the number of time segments in a duty cycle. In this manner, an average value will be calculated for the LED bank register 205 and the control algorithm can adjust the LED bank register 205 over a plurality of duty cycles to achieve the desired duty cycle, or a close approximation thereof. For example, if a duty cycle of 60% is desired and there are 256 time segments in a duty cycle, the LED bank register 205 should average 153.6. This could be achieved by, within every five duty cycles, setting the LED bank register 205 to 153 for two duty cycles and to 154 for three duty cycles. Other combinations to achieve the desired duty cycle are clearly possible.

As described above, a lighting apparatus according to the present invention can mitigate the magnitude and/or quantity of current fluctuations within the power supply. This reduction in magnitude of the current fluctuations and/or the reduction in the quantity of the current fluctuations can improve the performance of the power supply, increase the life of the power supply and/or reduce the potential for flicker within the lighting devices powered by the power supply. Further, the performance specification requirements for the power supply can potentially be reduced due to the reduction in the magnitude and/or quantity of current fluctuations. Lower performance specification requirements for the power supply can potentially result in a reduced cost associated with the power supply and hence a reduced cost for the overall lighting apparatus. This is particularly relevant since the cost of the power supply can be a significant portion of the overall cost of a lighting apparatus, especially a light emitting diode lighting apparatus.

In the above description, the embodiments of the present invention are directed to the controlling of a plurality of light emitting diodes within a lighting apparatus. It should be understood that the present invention can apply to the control of various types/colors of light emitting diodes, including but not limited to red, orange, yellow, green, blue, purple, violet, ultraviolet, infrared, white (blue/UV diode with phosphor), organic light emitting diodes, etc. Developments in light emitting diode technology are increasing dramatically and it is expected that new diodes that could be controlled using the solution of the present invention will be developed in the future. Further, non-light emitting diode lighting apparatus could benefit from the present invention, in particular lighting apparatus in which a plurality of lighting devices are pulse width modulated.

As described above, in some embodiments of the present invention, the banks of light emitting diodes comprise banks of light emitting diodes of different colors. In this case, the activation durations corresponding to the banks of light emitting diodes are set to generate a particular light spectrum output (i.e. a particular color or color temperature of light). In other embodiments, the banks of light emitting diodes comprise banks of light emitting diodes of a single color. In this case, a sum of the activation durations corresponding to the banks of light emitting diodes is an overall activation duration for the particular color. The overall activation duration can be set to generate a particular light intensity for the single color. Increasing/decreasing of the intensity (brightening/dimming of the lighting apparatus) could in this case be performed by increasing/reducing one or more of the activation durations corresponding to the banks of light emitting diodes. In one example, this embodiment could be implemented using white light emitting diodes.

Although various embodiments of the present invention have been described and illustrated, it will be apparent to those skilled in the art that numerous modifications and variations can be made without departing from the scope of the invention, which is defined in the appended claims.

What is claimed is:

1. A method for controlling pulse width modulated lighting devices within a lighting apparatus, the lighting apparatus comprising a plurality of sets of lighting devices, the method comprising:

setting a counter for a first set of the plurality of sets of lighting devices using a master counter and an activation duration for one or more other sets of the plurality of sets of lighting devices; and determining an activation time period within a duty cycle for the first set of lighting devices using the counter for the first set of lighting devices and an activation duration for the first set of lighting devices.

2. A method according to claim 1, further comprising setting an order for the plurality of sets of lighting devices; and wherein said activation duration of the one or more other sets of lighting devices comprises a sum of activation durations for sets of the plurality of sets of lighting devices ordered higher than the first set of lighting devices.

3. A method according to claim 2, wherein the sum of activation durations for sets of lighting devices ordered higher than the first set of lighting devices comprises a sum computed using modulo math with a base equal to a number of time segments within the duty cycle.

4. A method according to claim 2, wherein any carry bits generated during the sum of activation durations for sets of lighting devices ordered higher than the first set of lighting devices is ignored.

5. A method according to claim 1, wherein said determining the activation time period within the duty cycle for the first set of lighting devices comprises adding the counter for the first set of lighting devices and the activation duration for the first set of lighting devices, a resulting sum indicating whether to activate the first set of lighting devices.

6. A method according to claim 5, wherein for each particular time segment in the duty cycle, if the resulting sum is greater than or equal to a number of time segments in the duty cycle, the first set of lighting devices is activated and deactivated otherwise.

7. A method according to claim 5, wherein for each particular time segment in the duty cycle, if the resulting sum is less than a number of time segments in the duty cycle, the first set of lighting devices is activated and deactivated otherwise.

8. A method according to claim 1, further comprising activating the first set of lighting devices during the activation time period for the first set of lighting devices.

9. A method according to claim 1, further comprising:

setting a counter for a second set of the plurality of sets of lighting devices using the master counter, the activation duration for the one or more other sets of lighting devices and the activation duration for the first set of lighting devices; and determining an activation time period within the duty cycle for the second set of lighting devices using the counter for the second set of lighting devices and an activation duration for the second set of lighting devices.

10. A method according to claim 9, further comprising activating the first set of lighting devices during the activation time period for the first set of lighting devices and activating the second set of lighting devices during the activation time period for the second set of lighting devices; wherein the activation time periods for the first and second sets of lighting devices are synchronized to limit instantaneous fluctuations in current requirements for the first and second sets of lighting devices.

11. A method according to claim 1, wherein the first set of lighting devices comprises a set of light emitting diodes.

12. A method according to claim 11, wherein the set of light emitting diodes comprises light emitting diodes of one or more of: red, orange, yellow, green, blue, purple, violet, ultraviolet, infrared, white and organic light emitting diodes.

13. A method according to claim 1, wherein the first set of lighting devices comprises a plurality of lighting devices.

14. A method according to claim 1, wherein the first set of lighting devices comprises one lighting device.

15. A control apparatus comprising:

a plurality of interfaces, each coupled to a respective one of a plurality of sets of pulse width modulated lighting devices; and a processing entity, coupled to the plurality of interfaces, configured to set a counter for a first set of the plurality of sets of lighting devices using a master counter and an activation duration for one or more other sets of the plurality of sets of lighting devices, and to determine an activation time period within a duty cycle for the first set of lighting devices using the counter for the first set of lighting devices and an activation duration for the first set of lighting devices.

16. Computer-readable media containing a program element executable by a computing system to perform a method according to claim 1.

17. A method for controlling a plurality of sets of lighting devices, each of the sets of lighting devices having an activation duration within a duty cycle, the method comprising:

setting start and end times for activation of each of the plurality of sets of lighting devices within the duty cycle to activate the set of lighting devices for its corresponding activation duration;

wherein the plurality of sets of lighting devices are powered by a single power supply and the start and end times for activation of each of the plurality of sets of lighting devices are set to mitigate instantaneous fluctuations in current within the power supply; and wherein the plurality of sets of lighting devices comprises sets of lighting devices of a single color; and wherein a sum of the activation durations within the duty cycle corresponding to the plurality of sets of lighting devices comprises an overall activation duration for the single color, the overall activation duration being set [the activation durations within the duty cycle corresponding to the plurality of sets of lighting devices are set] to generate a particular light intensity for the single color.

18. A method according to claim 17, wherein the plurality of sets of lighting devices comprises a plurality of sets of white lighting devices.

19. A lighting apparatus comprising:

a plurality of sets of lighting devices of a single color operable to be powered by a single power supply, each of the sets of lighting devices having an activation duration within a duty cycle; and a control apparatus operable to set start and end times for activation of each of the plurality of sets of lighting devices within the duty cycle to activate the set of lighting devices for its corresponding activation duration; the start and end times for activation of each of the plurality of sets of lighting devices being set to mitigate instantaneous fluctuations in current within the power supply; wherein a sum of the activation durations within the duty cycle corresponding to the plurality of sets of lighting devices comprises an overall activation duration for the single color, the overall activation duration being set [the activation durations within the duty cycle corresponding to the plurality of sets of lighting devices are set] to generate a particular light intensity for the single color.

20. An apparatus according to claim 19, wherein the plurality of sets of lighting devices comprises a plurality of sets of white lighting devices.

* * * * *